US009770895B2

(12) United States Patent
Kamoda et al.

(10) Patent No.: US 9,770,895 B2
(45) Date of Patent: Sep. 26, 2017

(54) INTAGLIO PRINTING PRESS

(71) Applicant: KOMORI CORPORATION, Tokyo (JP)

(72) Inventors: Hiroyoshi Kamoda, Tsukuba (JP); Akehiro Kusaka, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/139,545

(22) Filed: Dec. 23, 2013

(65) Prior Publication Data

US 2014/0182465 A1 Jul. 3, 2014

(30) Foreign Application Priority Data

Dec. 28, 2012 (JP) ..... 2012-286888
Dec. 28, 2012 (JP) ..... 2012-286889
(Continued)

(51) Int. Cl.

| | |
|---|---|
| ***B41F 9/00*** | (2006.01) |
| ***B41F 19/02*** | (2006.01) |
| ***B41F 13/20*** | (2006.01) |
| ***B41F 13/14*** | (2006.01) |
| ***B41F 13/21*** | (2006.01) |
| ***B41F 9/02*** | (2006.01) |

(Continued)

(52) U.S. Cl.

CPC ..... *B41F 9/00* (2013.01); *B41F 21/00* (2013.01); *B41F 21/12* (2013.01); *B41F 9/021* (2013.01);

(Continued)

(58) Field of Classification Search

CPC .. B41F 13/21; B41F 9/02; B41F 9/021; B41F 13/14; B41F 13/20; B65H 2301/331; B65H 2601/272

See application file for complete search history.

(56) References Cited

U.S. PATENT DOCUMENTS 4,552,066 A 11/1985 Giori et al.
5,125,336 A * 6/1992 Germann ..... 101/137
(Continued)

FOREIGN PATENT DOCUMENTS

CN 1060063 A 4/1992
CN 101121311 A 2/2008
(Continued)

OTHER PUBLICATIONS

Chinese Office Action dated Mar. 15, 2017 issued in corresponding Chinese Application No. 201310724358.4.

*Primary Examiner* — R. A. Smith
*Assistant Examiner* — John M Royston
(74) *Attorney, Agent, or Firm* — Birch, Stewart, Kolasch & Birch, LLP

(57) ABSTRACT

An intaglio printing press includes: a first intaglio printing unit; a second intaglio printing unit; a dryer for drying a printed surface of a sheet subjected to printing by the first intaglio printing unit; a convertible unit which holds and conveys the sheet received from the first intaglio printing unit and passes the sheet to the second intaglio printing unit in such a way that a surface of the sheet to be subjected to intaglio printing by the second intaglio printing unit is switchable between one surface and another surface of the sheet; and a second skewing adjustment cylinder and a second circumferential adjustment cylinder which are disposed between the convertible unit and the second intaglio printing unit and which adjust a position of a pattern to be intaglio-printed on the sheet by the second intaglio printing unit.

12 Claims, 8 Drawing Sheets

(30) Foreign Application Priority Data

Oct. 9, 2013 (JP) ..... 2013-211696
Oct. 9, 2013 (JP) ..... 2013-211697

(51) Int. Cl.
*B41F 21/00* (2006.01)
*B41F 21/12* (2006.01)

(52) U.S. Cl.
CPC ..... *B41F 13/14* (2013.01); *B41F 13/20* (2013.01); *B41F 13/21* (2013.01); *B41F 19/02* (2013.01)

(56) References Cited

U.S. PATENT DOCUMENTS 5,461,977 A * 10/1995 Germann ..... 101/137
2002/0000166 A1 1/2002 Nakamura
2005/0247219 A1* 11/2005 Giancaterino et al. ..... 101/152
2006/0260485 A1* 11/2006 Ohsawa ..... B26F 1/384 101/230
2008/0034992 A1* 2/2008 Kusaka ..... 101/153
2008/0163772 A1* 7/2008 Kusaka ..... 101/248

FOREIGN PATENT DOCUMENTS

JP 61-32755 A 2/1986
JP 1-258950 A 10/1989
JP 7-17019 A 1/1995
JP 7-251495 A 10/1995
JP 2002-11847 A 1/2002
JP 2008-37037 A 2/2008
JP 2011-161708 A 8/2011
JP 2013-56425 A 3/2013

* cited by examiner

INTAGLIO PRINTING PRESS

TECHNICAL FIELD

The present invention relates to an intaglio printing press.

BACKGROUND ART

As an intaglio printing press configured to perform intaglio printing on a sheet, for example, Patent Literature 1 listed below describes an intaglio printing press which includes: a first intaglio printing unit configured to perform intaglio printing on one surface of the sheet; first drying means for drying the one surface of the sheet which is subjected to the intaglio printing by the first intaglio printing unit; a second intaglio printing unit configured to perform intaglio printing on the sheet dried by the first drying means; and print surface switching means for receiving the sheet from the first intaglio printing unit and passing the sheet to the second intaglio printing unit in such a way that a surface of the sheet to be subjected to intaglio printing by the second intaglio printing unit is switchable between the one surface and the other surface of the sheet.

In the intaglio printing press described in Patent Literature 1, the intaglio printing can be performed on both surfaces of the sheet in one sending operation or intaglio printing can be performed multiple times on one surface of the sheet in one sending operation by using the print surface switching means to switch the print surface of the sheet to be subjected to the intaglio printing by the second intaglio printing unit.

CITATION LIST

Patent Literatures

{Patent Literature 1} Japanese Patent Application Publication No. 2008-037037

{Patent Literature 2} Japanese Patent Application Publication No. 2002-011847

{Patent Literature 3} Japanese Patent Application Publication No. Hei 7-017019

{Patent Literature 4} Japanese Patent Application Publication No. 2013-056425

{Patent Literature 5} Japanese Patent Application Publication No. 2011-161708

SUMMARY OF INVENTION

Technical Problem

In a conventional intaglio printing press, since the position of a pattern to be printed on a sheet is deviated when the mounting position of an intaglio plate to an intaglio cylinder is deviated, the intaglio printing press is configured such that an operator visually can check the pattern test-printed on the sheet and adjust the registration of the sheet to be fed by sheet feeding means.

However, in an intaglio printing press like one described in Patent literature 1 and the like, when the deviation of the mounting position of the intaglio plate to the intaglio cylinder in the first intaglio printing unit is different from the deviation of the mounting position of the intaglio plate to the intaglio cylinder in the second intaglio printing unit, it is difficult to perform registration at high accuracy only by adjusting the registration of the sheet to be fed by the sheet feeding means.

In view of this, an object of the present invention is to provide an intaglio printing press capable of performing registration of patterns to be printed on a sheet by a first intaglio printing unit and a second intaglio printing unit at high accuracy.

Solution to Problem

An intaglio printing press of the present invention for solving the problems described above includes: a first intaglio printing unit which includes a first impression cylinder configured to hold and convey a sheet and a first intaglio cylinder being in contact with the first impression cylinder and configured to perform intaglio printing on the sheet held by the first impression cylinder;

a second intaglio printing unit which is disposed downstream of the first intaglio printing unit in a conveying direction of the sheet and which includes a second impression cylinder configured to hold and convey the sheet from the first impression cylinder of the first intaglio printing unit and a second intaglio cylinder being in contact with the second impression cylinder and configured to perform intaglio printing on the sheet held by the second impression cylinder; first-intaglio-printing drying means, disposed upstream of the second intaglio printing unit in the conveying direction of the sheet, for drying a printed surface of the sheet subjected to printing by the first intaglio printing unit; a convertible unit which is disposed between the first intaglio printing unit and the second intaglio printing unit and which holds and conveys the sheet received from the first intaglio printing unit and passes the sheet to the second intaglio printing unit in such a way that a surface of the sheet to be subjected to intaglio printing by the second intaglio printing unit is switchable between one surface and another surface of the sheet; and second-intaglio-printing registration adjustment means, disposed between the convertible unit and the second intaglio printing unit, for adjusting a position of a pattern to be intaglio-printed on the sheet by the second intaglio printing unit.

Moreover, the intaglio printing press of the present invention is characterized in that, in the intaglio printing press described above, the second-intaglio-printing registration adjustment means includes a second-intaglio-printing skewing adjustment cylinder which is disposed between the convertible unit and the second intaglio printing unit to be capable of receiving the sheet from the convertible unit and passing the sheet to the second intaglio printing unit and which has an axis inclinable with respect to an axis of the second intaglio cylinder of the second intaglio printing unit.

Furthermore, the intaglio printing press of the present invention is characterized in that, in the intaglio printing press described above, the second-intaglio-printing registration adjustment means includes a second-intaglio-printing circumferential adjustment cylinder which is disposed between the convertible unit and the second intaglio printing unit to be capable of receiving the sheet from the convertible unit and passing the sheet to the second intaglio printing unit and a rotation phase of which relative to the second intaglio cylinder of the second intaglio printing unit is adjustable.

Moreover, the intaglio printing press of the present invention is characterized in that the intaglio printing press described above includes: sheet feeding means for feeding the sheet to the first intaglio printing unit; and first-intaglio-printing registration adjustment means, disposed between the sheet feeding means and the first intaglio printing unit, for adjusting a position of a pattern to be intaglio-printed on the sheet by the first intaglio printing unit.

Furthermore, the intaglio printing press of the present invention is characterized in that, in the intaglio printing press described above, the first-intaglio-printing registration adjustment means includes a first-intaglio-printing skewing adjustment cylinder which is disposed between the sheet feeding means and the first intaglio printing unit to be capable of receiving the sheet from the sheet feeding means and passing the sheet to the first intaglio printing unit and which has an axis inclinable with respect to an axis of the first intaglio cylinder of the first intaglio printing unit.

Moreover, the intaglio printing press of the present invention is characterized in that, in the intaglio printing press described above, the first-intaglio-printing registration adjustment means includes a first-intaglio-printing circumferential adjustment cylinder which is disposed between the sheet feeding means and the first intaglio printing unit to be capable of receiving the sheet from the sheet feeding means and passing the sheet to the first intaglio printing unit and a rotation phase of which relative to the first intaglio cylinder of the first intaglio printing unit is adjustable.

Furthermore, the intaglio printing press of the present invention is characterized in that, in the intaglio printing press described above, the first impression cylinder of the first intaglio printing unit and the second impression cylinder of the second intaglio printing unit are connected to each other by only a cylinder configured to hold and convey the sheet.

Moreover, the intaglio printing press of the present invention is characterized in that the intaglio printing press described above further includes: first driving means for driving the first intaglio printing unit; and second driving means for driving the second intaglio printing unit.

Furthermore, the intaglio printing press of the present invention is characterized in that the intaglio printing press described above includes connecting-disconnecting means for disconnectably connecting the first driving means and the second driving means to each other.

Advantageous Effects of Invention

In the intaglio printing press of the present invention, since the second-intaglio-printing registration adjustment means is disposed between the convertible unit and the second intaglio printing unit, the position of the pattern to be printed on the sheet by the second intaglio printing unit can be adjusted. Accordingly, even when the mounting deviation of the intaglio plate to the first intaglio cylinder in the first intaglio printing unit is different from the mounting deviation of the intaglio plate to the second intaglio cylinder of the second intaglio printing unit, registration of the patterns to be intaglio-printed on the sheet by the first intaglio printing unit and the second intaglio printing unit can be performed at high accuracy.

DESCRIPTION OF EMBODIMENTS

An embodiment of an intaglio printing press of the present invention is described based on the drawings. However, the present invention is not limited to the embodiment described below based on the drawings.

Main Embodiment

A main embodiment of the intaglio printing press of the present invention is described based on FIGS. 1 to 8.

Figure 1:
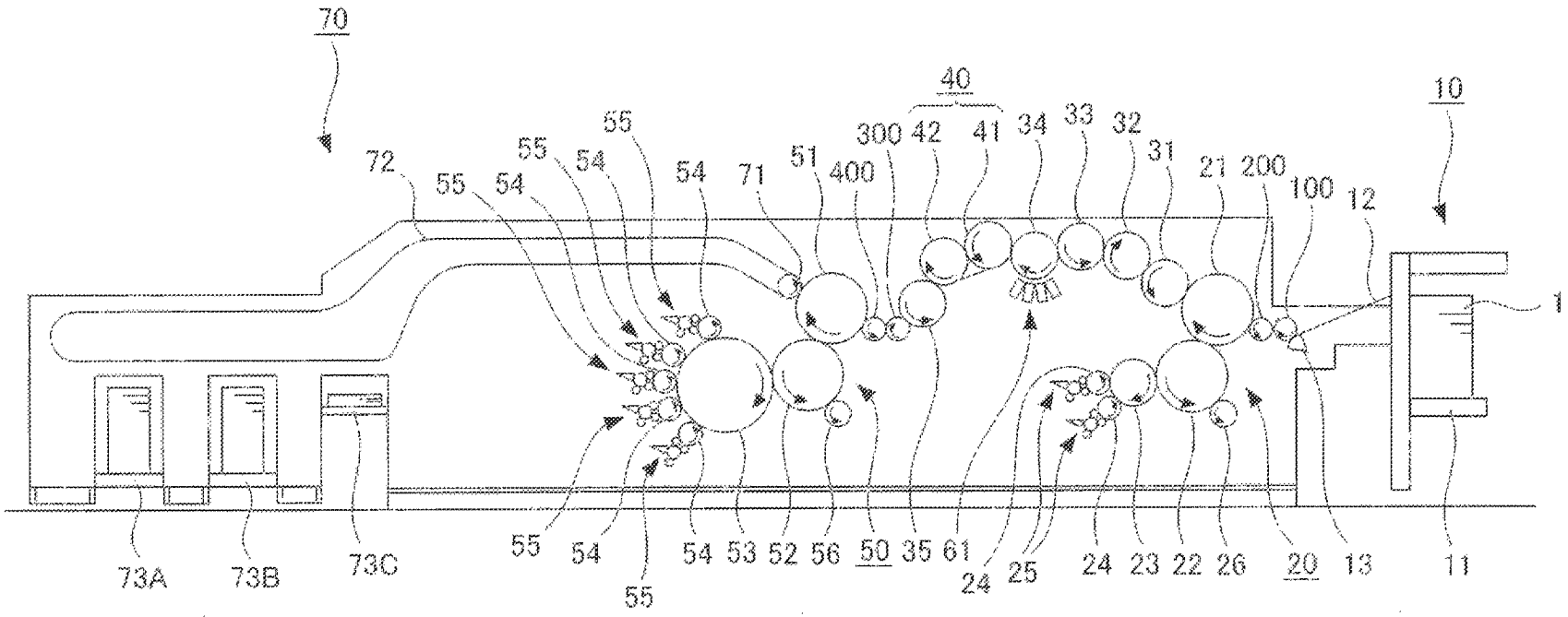
FIG. 1 shows an overall schematic configuration diagram of a main embodiment of an intaglio printing press of the present invention.

As shown in FIG. 1, a paper feeding device 10 which feeds paper sheets 1 on a paper feeding tray 11 one by one and a feeder board 12 which receives and conveys the paper sheets 1 sent out one by one from a top layer of the paper sheets 1 by a sucker mechanism of the paper feeding device 10 are connected to each other, the paper feeding device 10 being sheet feeding means, the paper sheets 1 being sheets, the paper feeding tray 11 being a sheet feeding tray. A swing arm shaft pregripper 13 configured to swing while gripping each paper sheet 1 on the feeder board 12 is disposed in a downstream end portion of the feeder board 12 in a conveying direction of the paper sheets 1.

A first skewing adjustment cylinder 100 which is a first-intaglio-printing skewing adjustment cylinder and which has a sheet holding device such as a gripper device configured to receive and hold the paper sheet 1 is disposed near the swing arm shaft pregripper 13. A first circumferential adjustment cylinder 200 which is a first-intaglio-printing circumferential adjustment cylinder and which has a sheet holding device such as a gripper configured to receive the paper sheet 1 from the first skewing adjustment cylinder 100 and hold the paper sheet 1 is in contact with the first skewing adjustment cylinder 100.

A first impression cylinder 21 which has a sheet holding device such as a gripper device configured to receive the paper sheet 1 from the first circumferential adjustment cylinder 200 and hold the paper sheet 1 is in contact with the first circumferential adjustment cylinder 200. A first plate (intaglio plate) cylinder 22 capable of holding an intaglio plate which is a printing plate is in contact with the first impression cylinder 21 of a first intaglio printing unit 20, the intaglio plate being detachably and attachably held on an outer peripheral surface of the first plate cylinder 22. A first ink collecting cylinder 23 having an outer peripheral surface around which a rubber blanket is wound is in contact with the intaglio plate of the first plate cylinder 22.

Two chablon rollers 24 arranged in a circumferential direction are in contact with the first ink collecting cylinder 23. An inking device 25 configured to supply an ink is in contact with each of the chablon rollers 24. The insides of the inking devices 25 are filled with inks of different colors. A first wiping roller 26 in contact with the intaglio plate on the outer peripheral surface of the first plate cylinder 22 is disposed below the first plate cylinder 22.

A transfer cylinder 31 which has a sheet holding device such as a gripper device configured to receive the paper sheet 1 from the first impression cylinder 21 and hold the paper sheet 1 is in contact with a portion of the first impression cylinder 21 which is downstream of a contact position with the first plate cylinder 22 and upstream of a contact position with the first circumferential adjustment cylinder 200 in a rotating direction.

A transfer cylinder 32 which has a sheet holding device such as a gripper device configured to receive the paper sheet 1 from the transfer cylinder 31 and hold the paper sheet 1 is in contact with the transfer cylinder 31. A transfer cylinder 33 which has a sheet holding device such as a gripper device configured to receive the paper sheet 1 from the transfer cylinder 32 and hold the paper sheet 1 is in contact with the transfer cylinder 32. A transfer cylinder 34 which has a sheet holding device such as a gripper device configured to receive the paper sheet 1 from the transfer cylinder 33 and hold the paper sheet 1 is in contact with the transfer cylinder 33.

A suction cylinder 41 of a convertible unit 40 is in contact with the transfer cylinder 34. A convertible cylinder 42 of the convertible unit 40 is in contact with the suction cylinder 41. A transfer cylinder 35 which has a sheet holding device such as a gripper device configured to receive the paper sheet 1 from the convertible cylinder 42 and hold the paper sheet 1 is in contact with the convertible cylinder 42.

The convertible unit 40 can be selectively switched, as necessary, between: a mode in which the sheet 1 received from the first impression cylinder 21 of the first intaglio printing unit 20 via the transfer cylinders 31 to 34 is held and conveyed without one surface and the other surface of the sheet 1 being reversed, and is then passed to the transfer cylinder 35; and a mode in which the received sheet 1 is held and conveyed with the one surface and the other surface thereof being reversed, and is then passed to the transfer cylinder 35 (for a specific structure, refer to, for example, Patent Literature 2 and the like listed above).

A dryer 61 which is first-intaglio-printing drying means and which dries the inks on a printed surface of the paper sheet 1 subjected to intaglio printing by the first intaglio printing unit 20 is disposed to face the transfer cylinder 34 in a portion which is downstream of a contact position of the transfer cylinder 34 with the transfer cylinder 33 and upstream of a contact position of the transfer cylinder 34 with the suction cylinder 41 in a rotating direction.

A second skewing adjustment cylinder 300 which is a second-intaglio-printing skewing adjustment cylinder and which has a sheet holding device such as a gripper device configured to receive the paper sheet 1 from the transfer cylinder 35 and hold the paper sheet 1 is in contact with the transfer cylinder 35. A second circumferential adjustment cylinder 400 which is a second-intaglio-printing circumferential adjustment cylinder and which has a sheet holding device such as a gripper device configured to receive the paper sheet 1 from the second skewing adjustment cylinder 300 and hold the paper sheet 1 is in contact with the second skewing adjustment cylinder 300.

A second impression cylinder 51 which has a sheet holding device such as a gripper device configured to receive the paper sheet 1 from the second circumferential adjustment cylinder 400 and hold the paper sheet 1 is in contact with the second circumferential adjustment cylinder 400. A second plate (intaglio plate) cylinder 52 capable of holding an intaglio plate which is a printing plate is in contact with the second impression cylinder 51 of a second intaglio printing unit 50, the intaglio plate being detachably and attachably held on an outer peripheral surface of the second plate cylinder 52. A second ink collecting cylinder 53 having an outer peripheral surface around which a rubber blanket is wound is in contact with the intaglio plate of the second plate cylinder 52.

Five chablon rollers 54 arranged in a circumferential direction are in contact with the second ink collecting cylinder 53. An inking device 55 configured to supply an ink is in contact with each of the chablon rollers 54. The insides of the inking devices 55 are filled with inks of different colors. A second wiping roller 56 in contact with the intaglio plate on the outer peripheral surface of the second plate cylinder 52 is disposed below the second plate cylinder 52.

A paper delivery cylinder 71 which is a sheet delivery cylinder is in contact with the second impression cylinder 51. A paper delivery chain 72 which is a sheet delivery chain of a paper delivery device 70 being sheet delivering means is passed around the paper delivery cylinder 71. Multiple gripper bars which are not illustrated are provided in the paper delivery chain 72 at predetermined intervals. Multiple paper receiving trays 73A to 73C which are sheet discharging trays are provided downstream of the paper delivery chain 72 in a travelling direction thereof.

Figure 2:
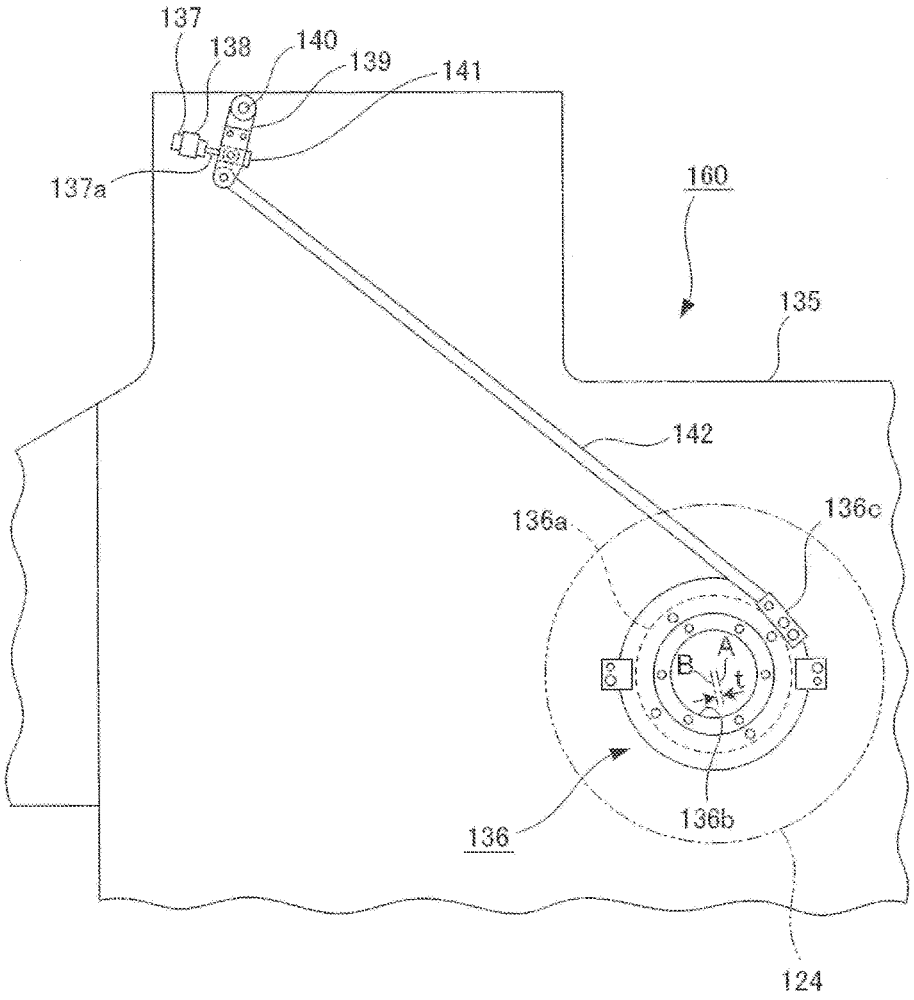
FIG. 2 shows a schematic side view of a skewing adjustment mechanism of a first skewing adjustment cylinder in the intaglio printing press of FIG. 1.
Figure 3:
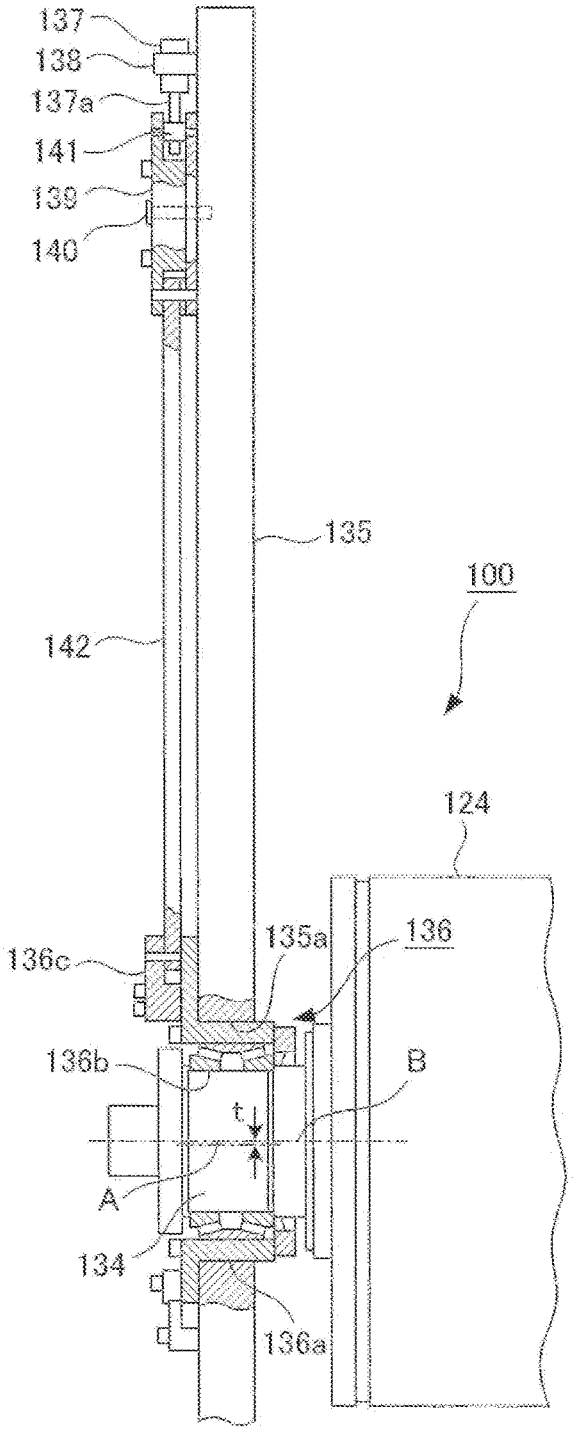
FIG. 3 shows a cutaway plan view of the skewing adjustment mechanism of the first skewing adjustment cylinder of FIG. 2.

Moreover, the first skewing adjustment cylinder 100 which is the first-intaglio-printing skewing adjustment cylinder includes a first skewing adjustment mechanism like one shown in FIGS. 2 and 3.

As shown in FIGS. 2 and 3, an end shaft of a cylinder main body 124 on a work side is rotatably and pivotally supported by an eccentric bearing 136 fitted to a bearing hole 135*a* of a frame 135 on the work side of a printing press main body. In the eccentric bearing 136, the axis A of an outer peripheral circle 136*a* on the frame side which is fitted to the bearing hole 135*a* is eccentric with the axis B of an inner peripheral circle 136*b* on the end shaft 134 side by an amount denoted by reference sign t in the drawings.

Meanwhile, a lever 139 is swingably and pivotally attached to the frame 135 by a pin 140. One end of a rod 142 is pivotally attached to a branching portion of the lever 139 on a swinging end side. The other end of the rod 142 is pivotally attached to a branching portion 136*c* formed in a flange portion of the eccentric bearing 136.

A first skewing adjustment motor 137 is supported on the frame 135 by a bracket 138 provided in the frame 135. A motor shaft 137*a* of the first skewing adjustment motor 137 is screwed to a threaded hole of a block 141 to be capable of advancing and retreating, the block 141 turnably and pivotally attached to the branching portion of the lever 139 on the swinging end side. Note that, since FIG. 3 is illustrated as a cutaway view, the block 141 and the one end of the rod 142 are pivotally and separately attached to respective upper and lower branching portions. However, the block 141 and the one end of the rod 142 are actually pivotally attached to the same branching portion.

In other words, when the first skewing adjustment motor 137 is activated to turn the motor shaft 137*a*, the lever 139 is made to swing by the block 141, the eccentric bearing 136 is turned by the rod 142 at a predetermined angle, and the eccentric effect of the eccentric bearing 136 causes the axis position of the cylinder main body 124 on the one end side to move from the axis A to the axis B. This causes the axis of the cylinder main body 124 to be inclined with respect to the axis of the first plate cylinder 22 of the first intaglio printing unit 20 and the position of a pattern to be printed on the paper sheet 1 by the first intaglio printing unit 20 can be adjusted in a skewing direction (for details, refer to, for example, Patent Literature 3 and the like listed above).

Figure 4:
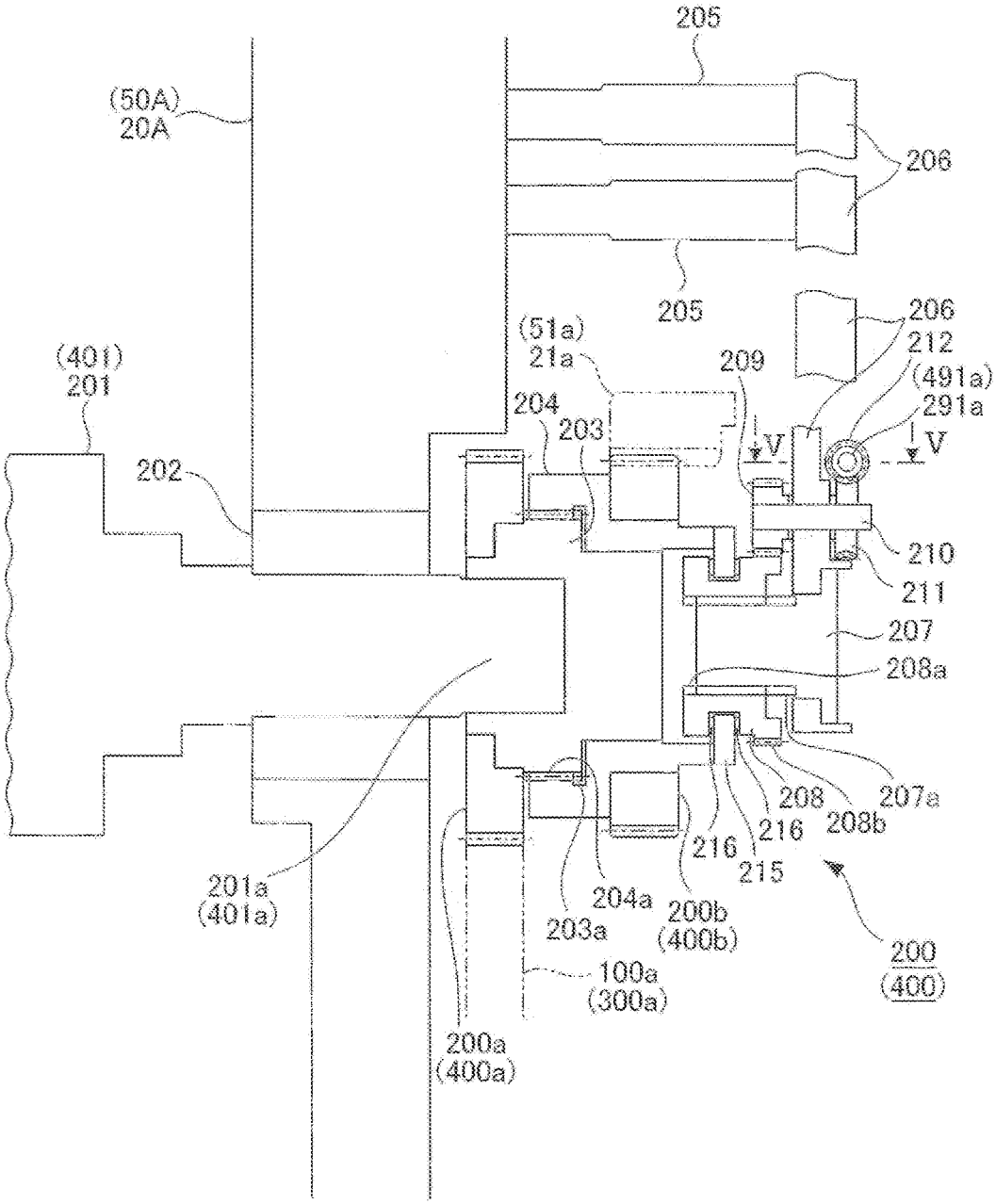
FIG. 4 shows a schematic front view of a circumferential adjustment mechanism in each of first and second circumferential adjustment cylinders in the intaglio printing press of FIG. 1.
Figure 5:
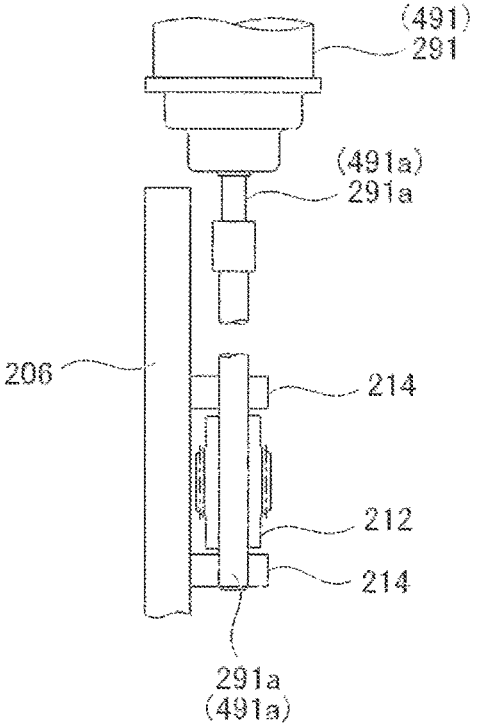
FIG. 5 shows a cross-sectional view taken along the V-V line of FIG. 4 as viewed in the direction of the arrows.

Moreover, the first circumferential adjustment cylinder 200 which is the first-intaglio-printing circumferential adjustment cylinder has a first circumferential adjustment mechanism like one shown in FIGS. 4 and 5.

As shown in FIG. 4, one shaft end 201*a* of a cylinder main body 201 is turnably supported by a frame 20A of the first intaglio printing unit 20 via a bearing 202. A transmission shaft 203 having a gear-shaped tooth portion 203*a* on an outer peripheral surface is coaxially attached to the shaft end 201*a* of the cylinder main body 201. A transmission tube 204 having a gear-shaped tooth portion 204*a* meshing with the tooth portion 203*a* in an inner peripheral surface is coaxially fitted to an outer peripheral surface of the transmission shaft 203 to be movable by sliding in an axial direction.

A base end side (right side in FIG. 4) of a threaded shaft 207 having a male thread portion 207*a* on a front end side (left side in FIG. 4) is fixedly supported by a subframe 206 to be coaxial with the cylinder main body 201, the subframe 206 supported on the frame 20A via a supporting member 205. A threaded tube 208 having a female thread portion 208*a* in an inner peripheral surface is screwed to the male thread portion 207*a* of the threaded shaft 207.

A gear-shaped tooth portion 208*b* is formed on the outer peripheral surface of the threaded tube 208 on an outer end portion side (right side in FIG. 4) in an axial direction of the cylinder main body 201. A gear 209 meshes with tooth portion 208*b* of the threaded tube 208. The gear 209 is coaxially attached to a front end side (left side in FIG. 4) of a rotary shaft 210 whose middle portion in an axial direction is rotatably supported by the subframe 206. A worm wheel 211 is coaxially attached to the based end side (right side in FIG. 4) of the rotary shaft 210. A worm 212 meshes with the worm wheel 211.

As shown in FIG. 5, a drive shaft 291*a* of a first circumferential adjustment motor 291 is coaxially attached to the worm 212. The first circumferential adjustment motor 291 is fixedly supported by the subframe 206 via a not-illustrated bracket and the drive shaft 291*a* is rotatably supported by brackets 214 fixedly supported by the subframe 206.

Specifically, when the drive shaft 291*a* of the first circumferential adjustment motor 291 is turned, the threaded tube 208 is turned in a circumferential direction via the worm 212, the worm wheel 211, the rotary shaft 210, and the gear 209 and the threaded tube 208 can be thereby moved relative to the threaded shaft 207 along an axial direction.

An annular rotating plate 215 is fitted to an outer peripheral surface of a middle portion of the threaded tube 208 in the axial direction thereof to be coaxial with the threaded tube 208. The rotating plate 215 is supported by a thrust bearing 216 to be rotatable relative to the threaded tube 208 in a circumferential direction. The outer peripheral portion of the rotating plate 215 is connected and fixed to an outer end portion (right side in FIG. 4) of the transmission tube 204 in the axial direction of the cylinder main body 201.

A helical gear 200*b* is coaxially attached to an outer peripheral surface of a middle portion of the transmission tube 204 in the axial direction thereof. A helical gear 21*a* provided coaxial with the first impression cylinder 21 and configured to rotate integrally with the first impression cylinder 21 meshes with the helical gear 200*b*. A helical gear 200*a* is coaxially attached to an outer surface of the transmission shaft 203 on the cylinder main body 201 side. A helical gear 100*a* provided coaxial with the cylinder main body 124 of the first skewing adjustment cylinder 100 and rotating integrally with the first skewing adjustment cylinder 100 meshes with the helical gear 200*a*.

Specifically, when the helical gear 100*a* of the first skewing adjustment cylinder 100 is rotated, the transmission shaft 203 is rotated by the helical gear 200*a* of the first circumferential adjustment cylinder 200. The cylinder main body 201 is thereby rotated and the helical gear 200*b* is also rotated by the transmission tube 204. A drive force is thus transmitted to the helical gear 21*a* of the first impression cylinder 21 and the first impression cylinder 21 is rotated. Moreover, when the threaded tube 208 is moved relative to the threaded shaft 207 in the axial direction by the action of the first circumferential adjustment motor 291, the transmission tube 204 is moved by the thrust bearing 216 and the rotating plate 215 to slide relative to the transmission shaft 203 in the axial direction, the helical gear 200*b* is moved relative to the helical gear 21*a* of the first impression cylinder 21 in the axial direction, and the meshing position of the helical gears 200*b* and 21*a* changes. Due to this, the rotation phase of the first impression cylinder 21 in the circumferential direction relative to the rotation phase of the cylinder main body 201 of the first circumferential adjustment cylinder 200 in the circumferential direction changes, i.e. the rotation phases of the cylinder main body 201 and the first impression cylinder 21 in the circumferential direction relative to each other are adjusted. Hence, the position of the pattern to be printed on the paper sheet 1 by the first intaglio printing unit 20 in the circumferential direction can be adjusted (for details, refer to, for example, Patent Literature 4 and the like listed above).

The second skewing adjustment cylinder 300 which is the second-intaglio-printing skewing adjustment cylinder includes a second skewing adjustment mechanism having a structure similar to that of the first skewing adjustment mechanism of the first skewing adjustment cylinder 100, and can thus adjust the position of a pattern to be printed on the paper sheet 1 by the second intaglio printing unit 50 in the skewing direction by an action of a second skewing adjustment motor 337 (see FIG. 8), in a way similar to that in the first skewing adjustment cylinder 100.

Moreover, the second circumferential adjustment cylinder 400 which is the second-intaglio-printing circumferential adjustment cylinder includes a second circumferential adjustment mechanism having a structure similar to that of the first circumferential adjustment mechanism of the first circumferential adjustment cylinder 200, and can thus adjust the position of the pattern to be printed on the paper sheet 1 by the second intaglio printing unit 50 in the circumferential direction by an action of a second circumferential adjustment motor 491 (see FIGS. 5 and 8), in away similar to that in the first circumferential adjustment cylinder 200.

Note that, in FIG. 4, reference numerals in the parenthesis are those in the case of the second intaglio printing unit 50. Reference numeral 50A denotes a frame of the second intaglio printing unit 50, reference numeral 401 denotes a cylinder main body of the second circumferential adjustment cylinder 400, 401*a* denotes a shaft end of the cylinder main body 401, 300*a* denotes a helical gear provided coaxial with the second skewing adjustment cylinder 300 and rotating integrally with the second skewing adjustment cylinder 300, 51*a* denotes a helical gear provided coaxially with the second impression cylinder 51 and rotating integrally with the second impression cylinder 51, 400*a* denotes a helical gear meshing with the helical gear 300*a*, 400*b* denotes a helical gear meshing with the helical gear 51*a*, and 491*a* denotes a drive shaft of the second circumferential adjustment motor 491.

Figure 7:
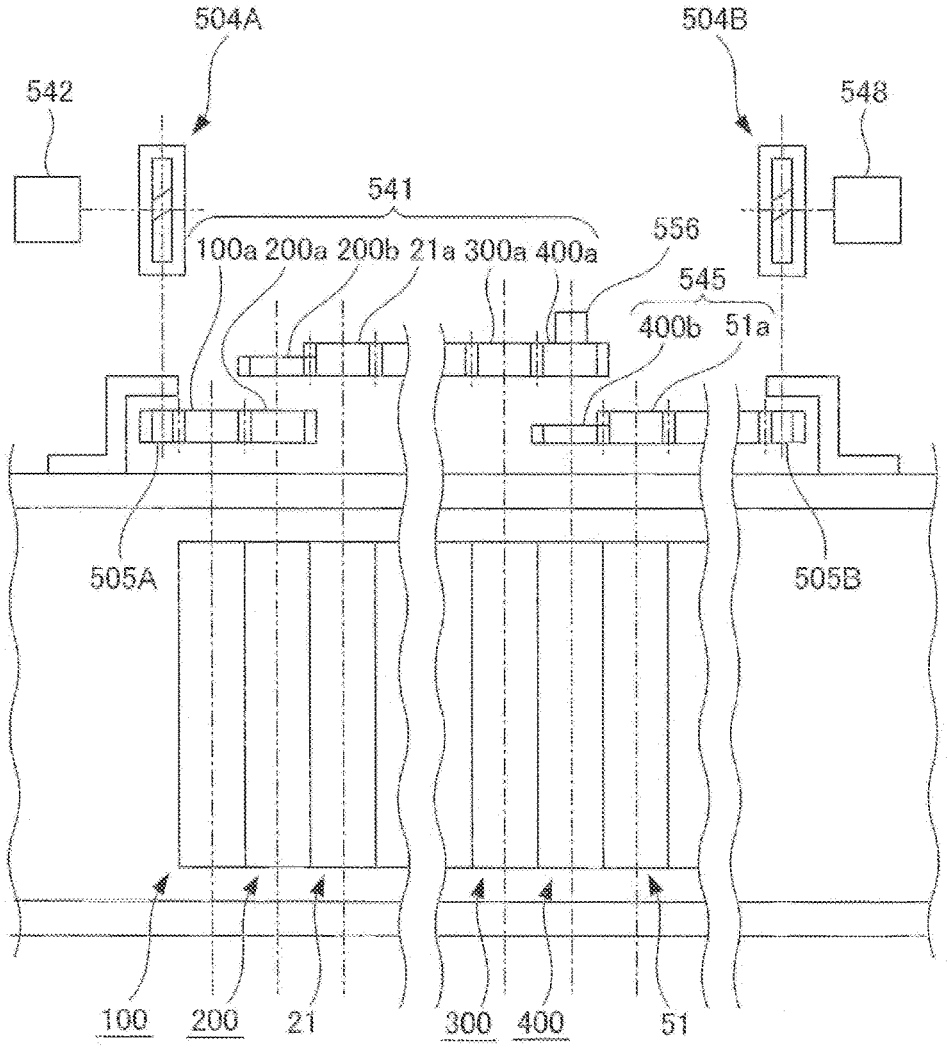
FIG. 7 shows a schematic configuration diagram of a power transmission system of a main portion of the intaglio printing press of FIG. 1.

Moreover, as shown in FIG. 7, the helical gear 100*a* of the first skewing adjustment cylinder 100, the helical gears 200*a*, 200*b* of the first circumferential adjustment cylinder 200, the helical gear 21*a* of the first impression cylinder 21 of the first intaglio printing unit 20, the helical gear 300*a* of the second skewing adjustment cylinder 300, and the helical gear 400*a* of the second circumferential adjustment cylinder 400 are connected to one another to synchronously rotate with helical gears (not illustrated) provided respectively in the first plate cylinder 22, the first ink collecting cylinder 23, the chablon rollers 24, the transfer cylinders 31 to 34, the suction cylinder 41 of the convertible unit 40, the convertible cylinder 42, and the transfer cylinder 35, and form a gear train 541.

Meanwhile, the helical gear 400*b* of the second circumferential adjustment cylinder 400 and the helical gear 51*a* of the second impression cylinder 51 of the second intaglio printing unit 50 are connected to each other to synchronously rotate with helical gears (not illustrated) provided respectively in the second plate cylinder 52, the second ink collecting cylinder 53, the chablon rollers 54, and the paper delivery cylinder 71, and form a gear train 545.

Moreover, the gear train 541 is connected to a first drive motor (main motor) 542 via a worm gear mechanism 504A. The gear train 545 is connected to a second drive motor (auxiliary motor) 548 via a worm gear mechanism 504B. An electromagnetic clutch 556 configured to engage with the second circumferential adjustment cylinder 400 in the rotating direction only at a predetermined rotation phase is assembled to the helical gear 400*a* of the second circumferential adjustment cylinder 400.

Specifically, when the clutch 556 is in an "on" state, the helical gear 400*a* of the second circumferential adjustment cylinder 400 is connected to the second circumferential adjustment cylinder 400 to rotate integrally therewith. The gear train 541 and the gear train 545 are thereby connected to each other and a drive force of the first drive motor 542 and a drive force of the second drive motor 548 can be transmitted together by using the gear train 541 and the gear train 545. When the clutch 556 is in an "off" state, the helical gear 400*a* of the second circumferential adjustment cylinder 400 is disconnected to be capable of rotating freely from the second circumferential adjustment cylinder 400. The connection between the gear train 541 and the gear train 545 are thereby cancelled and the drive force of the first drive motor 542 is transmitted only to the gear train 541 while the drive force of the second drive motor 548 is transmitted only to the gear train 545. Hence, the gear train 541 and the gear train 545 can be independently driven.

The paper feeding device 10, the intaglio printing units 20 and 50, the wiping rollers 26 and 56, the paper delivery device 70, and the like are driven respectively by different drive sources which are independent from each other. Moreover, reference numerals 505A and 505B in FIG. 7 are pinions of the helical gears.

Figure 6:
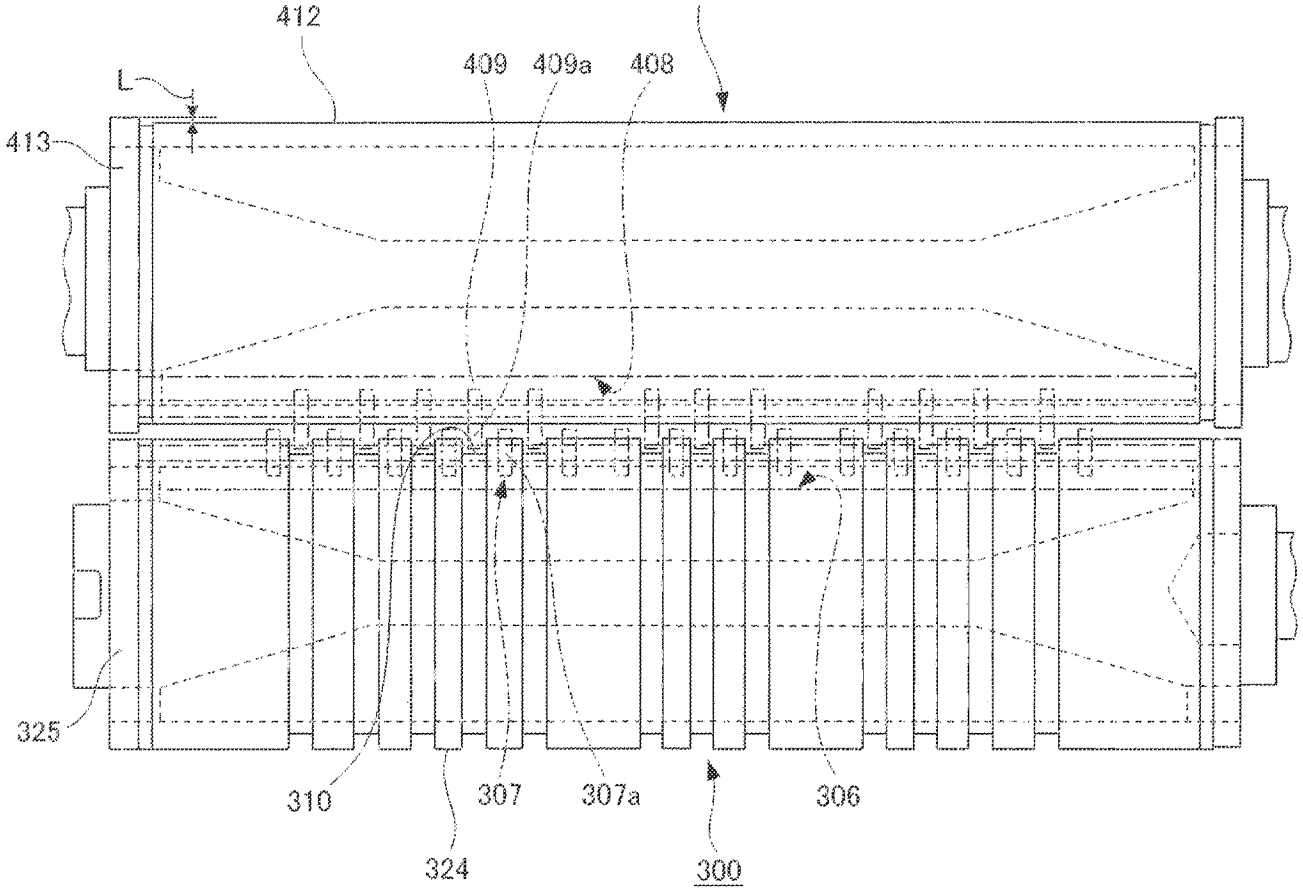
FIG. 6 shows a schematic configuration diagram of cylinder structures of a second skewing adjustment cylinder and the second circumferential adjustment cylinder in the intaglio printing press of FIG. 1.

Furthermore, as shown in FIG. 6, in a portion between the second skewing adjustment cylinder 300 and the second circumferential adjustment cylinder 400, gripper devices 307 and 409 are installed respectively inside notch portions 306 and 408 and gripper avoiding mechanisms for many grippers 307*a* and 409*a* in the gripper devices 307 and 409 are provided.

Annular grooves 310 are formed in a peripheral surface of a cylinder main body 324 of the second skewing adjustment cylinder 300 at positions corresponding to the grippers 409*a* of the second circumferential adjustment cylinder 400, as the gripper avoiding mechanism of the second skewing adjustment cylinder 300. The greatly-protruding grippers 409*a* of the second circumferential adjustment cylinder 400 are inserted into the annular grooves 310 and interference (contact or the like) between the second skewing adjustment cylinder 300 and the grippers 409*a* is thereby avoided.

Meanwhile, as the gripper avoiding mechanism of the second circumferential adjustment cylinder 400, a cylinder main body 412 of the second circumferential adjustment cylinder 400 is formed to have a diameter smaller than that of a bearer 413 by a dimension L, and interference (contact or the like) between the second circumferential adjustment cylinder 400 and front end portions of the grippers 307*a* of the second skewing adjustment cylinder 300 is thereby avoided, the grippers 307*a* having a protruding amount smaller than that of the grippers 409*a* of the second circumferential adjustment cylinder 400. Note that reference numeral 325 in FIG. 6 denotes a bearer.

Figure 8:
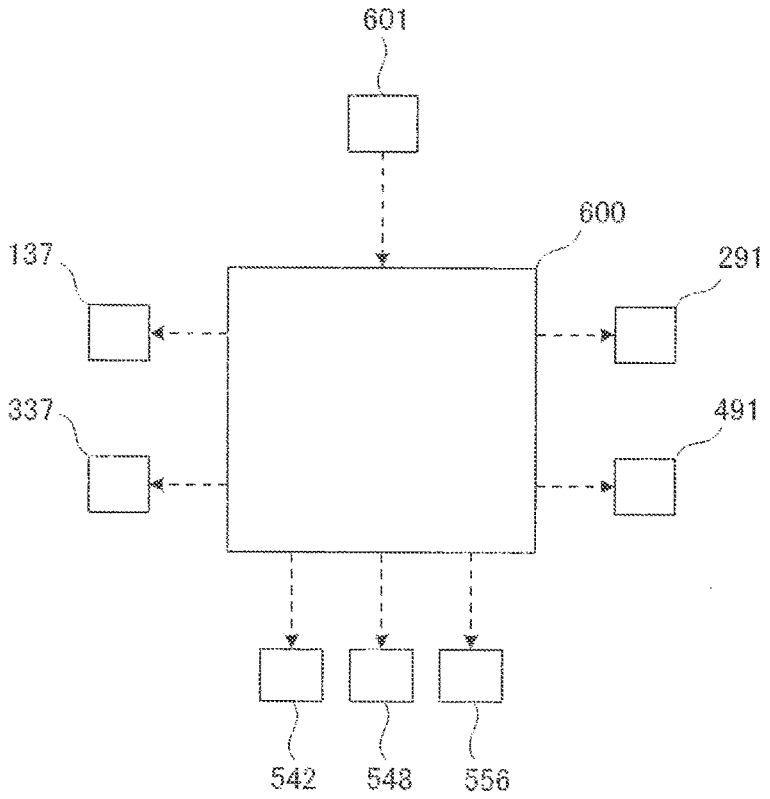
FIG. 8 shows a block diagram of a control system of the main portion of the intaglio printing press of FIG. 1.

Moreover, as shown in FIG. 8, outputs of a control device 600 which is controlling means are electrically connected to the first skewing adjustment motor 137, the first circumferential adjustment motor 291, the second skewing adjustment motor 337, the second circumferential adjustment motor 491, the first drive motor 542, the second drive motor 548, and the clutch 556. An input unit 601 which is inputting means for inputting various kinds of signals is electrically connected to an input of the control device 600 and the control device 600 can control the actions of the motors 137, 291, 337, 491, 542, and 548 and the clutch 556 on the basis of signals inputted from the input unit 601 (details will be described later).

Note that, in the embodiment, the first skewing adjustment cylinder 100, the first circumferential adjustment cylinder 200, and the like form first-intaglio-printing registration adjustment means. The second skewing adjustment cylinder 300, the second circumferential adjustment cylinder 400, and the like form second-intaglio-printing registration adjustment means. The worm gear mechanism 504A, the pinion 505A, the gear train 541, the first drive motor 542, and the like form first driving means. The worm gear mechanism 504B, the pinion 505B, the gear train 545, the second drive motor 548, and the like form second driving means. The clutch 556 and the like form connecting-disconnecting means.

Next, actions of the aforementioned intaglio printing press of the embodiment are described.

For example, in a case where two types of intaglio printing is to be performed only on one surface of each paper sheet 1, the convertible unit 40 is set such that the paper sheet 1 from the transfer cylinder 34 is passed to transfer cylinder 35 without the one surface and the other surface being reversed.

Subsequently, the printing operation is started by setting the clutch 556 to "on" to connect the gear train 541 and the gear train 545 to each other and by inputting a signal to the input unit 601 to activate the drive motors 542 and 548 and the like.

This causes the paper sheets 1 on the paper feeding tray 11 of the paper feeding device 10 to be fed one by one onto the feeder board 12. Each paper sheet 1 is then passed to the first skewing adjustment cylinder 100 by the swing arm shaft pregripper 13, and passed to the first impression cylinder 21 of the first intaglio printing unit 20 via the first circumferential adjustment cylinder 200 while being held and conveyed with the one surfaces facing the outer side. Meanwhile, the inks in the respective inking devices 25 are transferred to the first ink collecting cylinder 23 via the chablon rollers 24 to be supplied onto the surface of the intaglio plate of the first plate cylinder 22, excessive inks are removed by the first wiping roller 26, the inks on the intaglio plate are transferred onto the one surface of the paper sheet 1 when the paper sheet 1 passes through a portion between the first impression cylinder 21 and the first plate cylinder 22, and the one surface is thus subject to intaglio printing.

The paper sheet 1 subjected to intaglio printing on the one surface is passed to the transfer cylinder 34 via the transfer cylinders 31 to 33 and the inks printed on the one surface are dried by the dryer 61. Thereafter, the paper sheet 1 is passed to the second skewing adjustment cylinder 300 via the suction cylinder 41 and the convertible cylinder 42 of the convertible unit 40 as well as the transfer cylinder 35, and are conveyed to the second impression cylinder 51 of the second intaglio printing unit 50 via the second circumferential adjustment cylinder 400 while being held with the one surface facing the outer side. Meanwhile, the inks in the respective inking devices 55 are transferred to the second ink collecting cylinder 53 via the chablon rollers 54 to be supplied onto the surface of the intaglio plate of the second plate cylinder 52, excessive inks are removed by the second wiping roller 56, the inks on the intaglio plate are transferred onto the one surface of the paper sheet 1 when the paper sheet 1 pass through a portion between the second impression cylinder 51 and the second plate cylinder 52, and the one surface is thus subject to intaglio printing again.

The paper sheet 1 subjected to intaglio printing on the one surfaces again in the second intaglio printing unit 50 as described above is conveyed to the paper delivery chain 72 via the paper delivery cylinder 71 of the paper delivery device 70, held and conveyed by the gripper bars of the paper delivery chain 72, and delivered to the paper receiving trays 73A to 73C to be stacked thereon.

Meanwhile, for example, in a case where intaglio printing is to be performed on the one surface and the other surface of each paper sheet 1, the convertible unit 40 is set such that the paper sheet 1 from the transfer cylinder 34 is passed to transfer cylinder 35 with the one surface and the other surface of the paper sheet 1 being reversed.

Subsequently, as in the above description, the printing operation is started by setting the clutch 556 to "on" to connect the gear train 541 and the gear train 545 to each other and by inputting a signal to the input unit 601 to activate the drive motors 542 and 548 and the like.

As in the above description, this causes the paper sheets 1 on the paper feeding tray 11 of the paper feeding device 10 to be fed one by one onto the feeder board 12. Each paper sheet 1 is then passed to the first skewing adjustment cylinder 100 by the swing arm shaft pregripper 13, and passed to the first impression cylinder 21 of the first intaglio printing unit 20 via the first circumferential adjustment cylinder 200 while being held and conveyed with the one surfaces facing the outer side. The inks are transferred onto the one surface of the paper sheet 1 when the paper sheet 1 passes through the portion between the first impression cylinder 21 and the first plate cylinder 22, and the paper sheet 1 is thus subject to intaglio printing. Thereafter, the paper sheet 1 is passed to the transfer cylinder 34 via the transfer cylinders 31 to 33 and the inks printed on the one surfaces are dried by the dryer 61.

Then, the paper sheet 1 in which the inks printed on the one surfaces are dried is reversed by the suction cylinder 41 and the convertible cylinder 42 of the convertible unit 40 (for specific actions, refer to, for example, Patent Literature 2 and the like listed above), passed to the second skewing adjustment cylinder 300 via the transfer cylinder 35, and conveyed to the second impression cylinder 51 of the second intaglio printing unit 50 via the second circumferential adjustment cylinder 400 while being held with the other surface facing the outer side. When the paper sheet 1 pass through the portion between the second impression cylinder 51 and the second plate cylinder 52, the inks are transferred also to the other surface and the other surfaces are thus subject to intaglio printing.

The paper sheet 1 subjected to intaglio printing on the other surface in the second intaglio printing unit 50 as described above is conveyed to the paper delivery chain 72 via the paper delivery cylinder 71 of the paper delivery device 70, held and conveyed by the gripper bars of the paper delivery chain 72, and delivered to the paper receiving trays 73A to 73C to be stacked thereon as in the above description.

An operator visually checks the printing state of the paper sheet 1 subjected to intaglio printing by the intaglio printing units 20 and 50 and delivered onto the paper receiving trays 73A to 73C of the paper delivery device 70 as described above. For example, when the pattern printed by the first intaglio printing unit 20 is deviated in the skewing direction, the operator inputs a skewing adjustment amount (for example, +1 mm or the like) for correcting the deviation to the input unit 601.

Based on a command from the input unit 601, the control device 600 controls an action of the first skewing adjustment motor 137 of the first skewing adjustment cylinder 100 in such a way that the action corresponds to the inputted skewing adjustment amount. The lever 139 is thus made to swing by the block 141 and the rod 142 pivotally attached to the swinging end portion of the lever 139 advances or retreats. The eccentric bearing 136 to which the front end of the rod 142 is pivotally attached is thus turned at a desired angle and the axial position of the cylinder main body 124 on the one end side is moved from the axis A to the axis B by the eccentric effect of the eccentric bearing 136, thereby causing the axis of the cylinder main body 124 to incline. The deviation of the position of the pattern to be printed on the paper sheet 1 by the first intaglio printing unit 20 is thus adjusted in the skewing direction.

Moreover, for example, when the pattern intaglio-printed on the paper sheet 1 by the first intaglio printing unit 20 is deviated in the circumferential direction, the operator inputs the circumferential adjustment amount (for example, −1 mm or the like) for correcting the deviation to the input unit 601.

Based on a command from the input unit 601, the control device 600 controls an action of the first circumferential adjustment motor 291 in such a way that the helical gear 200*b* is moved in the axial direction by a movement amount of the helical gear 200*b* in the axial direction which corresponds to the inputted circumferential adjustment amount. The helical gear 200*b* is thus moved relative to the helical gear 21*a* of the first impression cylinder 21 in the axial direction and the meshing position of the helical gear 21*a* with the helical gear 200*b* is changed. Due to this, the rotation phase of the first impression cylinder 21 in the circumferential direction relative to the rotation phase of the cylinder main body 201 of the first circumferential adjustment cylinder 200 in the circumferential direction changes, i.e. the rotation phases of the cylinder main body 201 and the first impression cylinder 21 in the circumferential direction relative to each other are adjusted.

The gripper device of the first impression cylinder 21 can thereby receive the paper sheet 1 from the gripper device of the first circumferential adjustment cylinder 200 at a timing of the rotation phase corresponding to the circumferential adjustment amount. Accordingly, the paper sheet 1 is subjected to intaglio printing by the first plate cylinder 22 while being held by the gripper device of the first impression cylinder 21 in a state shifted by the circumferential adjustment amount. The deviation of the position of the pattern to be printed by the first intaglio printing unit 20 is thus adjusted in the circumferential direction.

Meanwhile, when the pattern intaglio-printed on the paper sheet 1 by the second intaglio printing unit 50 is deviated in the skewing direction, the operator inputs a skewing adjustment amount (for example, +2 mm or the like) for correcting the deviation to the input unit 601. Then, based on a command from the input unit 601, the control device 600 controls an action of the second skewing adjustment motor 337 of the second skewing adjustment cylinder 300 in a such a way that the action corresponds to the inputted skewing adjustment amount. The axis is thereby inclined in the second skewing adjustment cylinder 300 as in the first skewing adjustment cylinder 100 and the deviation is adjusted in the skewing direction.

Moreover, for example, when the pattern intaglio-printed on the paper sheet 1 by the second intaglio printing unit 50 is deviated in the circumferential direction, the operator inputs the circumferential adjustment amount (for example, −2 mm or the like) for correcting the deviation to the input unit 601. Then, based on a command from the input unit 601, the control device 600 controls an action of the second circumferential adjustment motor 491 of the second circumferential adjustment cylinder 400 in such a way that the action corresponds to the inputted circumferential adjustment amount. The rotation phase is thereby adjusted in the second circumferential adjustment cylinder 400 as in the first circumferential adjustment cylinder 200 and the deviation is adjusted in the circumferential direction.

By adjusting the deviations with the adjustment cylinders 100, 200, 300, and 400 as described above, the positions of the patterns to be intaglio-printed by the first intaglio printing unit 20 and the second intaglio printing unit 50 can be set as specified.

Moreover, assume a case where the printing operation like one describe above is completed and printing preparation work and maintenance and checking work such as replacing of the intaglio plates of the plate cylinders 22 and 52 in the intaglio printing units 20 and 50 and cleaning of the ink collecting cylinders 23 and 53, the chablon rollers 24 and 25, and the like are to be performed. In this case, first, the operator operates the input unit 601 in such a way that the gear train 541 and the gear train 545 are disconnected from each other. In response to this operation, the control unit 600 controls the action of the clutch 556 in such a way that the clutch 556 is set to "off".

Then, when the operator operates the input unit 601 in such a way that the first drive motor 542 is activated, the control device 600 activates the first drive motor 542. The drive force of the first drive motor 542 is thereby transmitted only to the gear train 541 and not to the gear train 545, and the first drive motor 542 activates only the first intaglio printing unit 20 without activating the second intaglio printing unit 50.

Meanwhile, when the operator operates the input unit 601 in such a way that the second drive motor 548 is activated, the control device 600 activates the second drive motor 548. The drive force of the second drive motor 548 is thereby transmitted only to the gear train 545 and not to the gear train 541, and the second drive motor 548 activates only the second intaglio printing unit 50 without activating the first intaglio printing unit 20.

Here, the rotation phases of first skewing adjustment cylinder 100, the first circumferential adjustment cylinder 200, the first impression cylinder 21 of the first intaglio printing unit 20, the first plate cylinder 22, the first ink collecting cylinder 23, the chablon rollers 24, the transfer cylinders 31 to 34, the suction cylinder 41 of the convertible unit 40, the convertible cylinder 42, the transfer cylinder 35, and the second skewing adjustment cylinder 300 which are rotated by the drive force of the first drive motor 542 via the gear train 541 are different from the rotation phases of the second circumferential adjustment cylinder 400, the second impression cylinder 51 of the second intaglio printing unit 50, the second plate cylinder 52, the second ink collecting cylinder 53, the chablon rollers 54, and the paper delivery cylinder 71 which are rotated by the drive force of the second drive motor 548 via the gear train 545. However, since the second skewing adjustment cylinder 300 and the second circumferential adjustment cylinder 400 respectively have the gripper avoiding mechanisms described above, the interference (contact or the like) therebetween can be avoided.

This configuration allows the first intaglio printing unit 20 and the second intaglio printing unit 50 to be independently activated by the first drive motor 542 and the second drive motor 548 by setting the clutch 556 to "off".

Accordingly, the printing preparation work, the maintenance and checking work, and the like of the first intaglio printing unit 20 and the printing preparation work, the maintenance and checking work, and the like of the second intaglio printing unit 50 can be independently and simultaneously performed in parallel.

Thus, the following effects can be obtained from the intaglio printing press of the embodiment.

(1) Since the second skewing adjustment cylinder 300 configured to adjust the deviation of the position of the pattern to be printed on the paper sheet 1 in the skewing direction is disposed between the convertible unit 40 and the second intaglio printing unit 50, the pattern to be printed on the paper sheet 1 by the second intaglio printing unit 50 can be adjusted in the skewing direction. Accordingly, even when the attachment deviation of the intaglio plate to the first plate cylinder 22 of the first intaglio printing unit 20 in the skewing direction is different from the attachment deviation of the intaglio plate to the second plate cylinder 52 of the second intaglio printing unit 50 in the skewing direction, the registration of the patterns to be intaglio-printed on the paper sheet 1 by the first intaglio printing unit 20 and the second intaglio printing unit 50 in the skewing direction can be performed at high accuracy.

(2) Since the second circumferential adjustment cylinder 400 configured to adjust the deviation of the position of the pattern to be printed on the paper sheet 1 in the circumferential direction is disposed between the convertible unit 40 and the second intaglio printing unit 50, the pattern to be printed on the paper sheet 1 by the second intaglio printing unit 50 can be adjusted in the circumferential direction. Accordingly, even when the attachment deviation of the intaglio plate to the first plate cylinder 22 of the first intaglio printing unit 20 in the circumferential direction is different from the attachment deviation of the intaglio plate to the second plate cylinder 52 of the second intaglio printing unit 50 in the circumferential direction, the registration of the patterns to be intaglio-printed on the paper sheet 1 by the first intaglio printing unit 20 and the second intaglio printing unit 50 in the circumferential direction can be performed at high accuracy.

(3) Since the first skewing adjustment cylinder 100 configured to adjust the deviation of the position of the pattern to be printed on the paper sheet 1 in the skewing direction is disposed between the paper feeding device 10 and the first intaglio printing unit 20, the adjustment of the pattern to be printed on the paper sheet 1 by the first intaglio printing unit 20 in the skewing direction can be performed in addition to adjustment in the paper feeding device 10. Accordingly, the registration of the pattern to be intaglio-printed on the paper sheet 1 in the skewing direction can be performed at higher accuracy.

(4) Since the first circumferential adjustment cylinder 200 configured to adjust the deviation of the position of the pattern to be printed on the paper sheet 1 in the circumferential direction is disposed between the paper feeding device 10 and the first intaglio printing unit 20, the adjustment of the pattern to be printed on the paper sheet 1 by the first intaglio printing unit 20 in the circumferential direction can be performed in addition to the adjustment in the paper feeding device 10. Accordingly, the registration of the pattern to be intaglio-printed on the paper sheet 1 in the circumferential direction can be performed at higher accuracy.

(5) Since it is possible to perform multiple (five) color intaglio printing by the second intaglio printing unit 50 and also perform multiple (two) color intaglio printing by the first intaglio printing unit 20, multiple color printing can be performed on both surfaces of the paper sheet 1 by using only two printing units 20 and 50. Accordingly, there is no need to prepare printing units for respective colors. Thus it is possible to prevent an increase in the size of the printing press and save space.

(6) Since the first intaglio printing unit 20 and the second intaglio printing unit 50 can be independently activated by the first drive motor 542 and the second drive motor 548 by setting the clutch 556 to "off", the printing preparation work, the maintenance and checking work, and the like of the first intaglio printing unit 20 and the printing preparation work, the maintenance and checking work, and the like of the second intaglio printing unit 50 can be independently and simultaneously performed in parallel. Hence, the work efficiency can be greatly improved.

(7) Since the printing press can be activated with the drive force of the first drive motor (main motor) 542 and the drive force of the second drive motor (auxiliary motor) 548 being combined by setting the clutch 556 to the "on" state and connecting the gear train 541 and the gear train 545 to each other (torque help function), the drive motors 542 and 548 can be reduced in sizes than those in the case where the first intaglio printing unit 20 and the second intaglio printing unit 50 are activated by one drive motor (main motor). Hence, space saving and low cost can be achieved. Moreover, the gear train 541 and gear train 545 can be surely synchronized compared to a case where the first drive motor 542 and the second drive motor 548 are controlled to achieve synchronization without using the clutch 556. Hence, the accuracy of the registration can be more surely improved.

(8) Since the first impression cylinder 21 of the first intaglio printing unit 20 and the second impression cylinder 51 of the second intaglio printing unit 50 are connected to each other by only the cylinders 31 to 35, 41, 42, 300, and 400 which are capable of holding and conveying the paper sheet 1, deviation occurring in the passing and receiving of the paper sheet 1 can be greatly reduced compared to a case where a conveying chain like one used in the paper delivery device 70 to which multiple gripper bars are attached at predetermined intervals is provided between the impression cylinders 21 and 51 to connect the impression cylinders 21 and 51. Accordingly, the registration can be performed at higher accuracy.

Other Embodiments

In the embodiment described above, the gear train 541 connected to the first drive motor (main motor) 542 connects the first skewing adjustment cylinder 100, the first circumferential adjustment cylinder 200, the first impression cylinder 21 of the first intaglio printing unit 20, the first plate cylinder 22, the first ink collecting cylinder 23, the chablon rollers 24, the transfer cylinders 31 to 34, the suction cylinder 41 of the convertible unit 40, the convertible cylinder 42, the transfer cylinder 35, and the second skewing adjustment cylinder 300 to each other, the gear train 545 connected to the second drive motor (auxiliary motor) 548 connects the second circumferential adjustment cylinder 400, the second impression cylinder 51 of the second intaglio printing unit 50, the second plate cylinder 52, the second ink collecting cylinder 53, the chablon rollers 54, and the paper delivery cylinder 71 to each other, the gear train 541 and the gear train 545 are disconnectably connected to each other via the clutch 556, and the second skewing adjustment cylinder 300 and the second circumferential adjustment cylinder 400 include the gripper avoiding mechanisms. However, for example, the following configuration can be employed as another embodiment. A gear train connected to an auxiliary motor connects the first skewing adjustment cylinder 100, the first circumferential adjustment cylinder 200, the first impression cylinder 21 of the first intaglio printing unit 20, the first plate cylinder 22, the first ink collecting cylinder 23, the chablon rollers 24 and the transfer cylinder 31 to each other, a gear train connected to a main motor connects the transfer cylinders 32 to 34, the suction cylinder 41 of the convertible unit 40, the convertible cylinder 42, the transfer cylinder 35, the second skewing adjustment cylinder 300, the second circumferential adjustment cylinder 400, the second impression cylinder 51 of the second intaglio printing unit 50, the second plate cylinder 52, the second ink collecting cylinder 53, the chablon rollers 54, and the paper delivery cylinder 71 to each other, the gear trains are connected to each other by connecting-disconnecting means, and the transfer cylinder 31 and the transfer cylinder 32 include gripper avoiding mechanisms.

Moreover, in the embodiment described above, the circumferential adjustment cylinders 200 and 400 are disposed downstream respectively of the skewing adjustment cylinders 100 and 300 in the conveying direction of the paper sheet 1, i.e. the skewing adjustment cylinders 100 and 300 are disposed upstream respectively of the circumferential adjustment cylinders 200 and 400 in the conveying direction of the paper sheet 1. However, as another embodiment, for example, the skewing adjustment cylinders 100 and 300 can be disposed downstream respectively of the circumferential adjustment cylinders 200 and 400 in the conveying direction of the paper sheet 1, i.e. the circumferential adjustment cylinders 200 and 400 can be disposed upstream respectively of the skewing adjustment cylinders 100 and 300 in the conveying direction of the paper sheet 1.

Furthermore, in the embodiment described above, the four transfer cylinders 31 to 34 are disposed between the impression cylinder 21 of the first intaglio printing unit 20 and the suction cylinder 41 of the convertible unit 40. However, for example, the following configuration can be employed as another embodiment. An even number of transfer cylinders (conveying cylinders) are disposed between the impression cylinder 21 and the suction cylinder 41 and the dryer 61 is disposed to face an even-numbered transfer cylinder (conveying cylinder).

INDUSTRIAL APPLICABILITY

Since the intaglio printing press of the present invention can perform the registration of the patterns to be intaglio-printed on the sheet by the first intaglio printing unit and the second intaglio printing unit at high accuracy, the intaglio printing press can be highly useful in the printing industry.

REFERENCE SIGNS LIST

1 paper sheet
10 paper feeding device
11 paper feeding tray
12 feeder board
13 swing arm shaft pregripper
20 first intaglio printing unit
21 first impression cylinder
22 first plate cylinder
23 first ink collecting cylinder
24 chablon roller
25 inking device
26 first wiping roller
31 to 35 transfer cylinder
40 convertible unit
41 suction cylinder
42 convertible cylinder
50 second intaglio printing unit
51 second impression cylinder
52 second plate cylinder
53 second ink collecting cylinder
54 chablon roller
55 inking device
56 second wiping roller
61 dryer
70 paper delivery device
71 paper delivery cylinder
72 paper delivery chain
73A to 73C paper receiving tray
100 first skewing adjustment cylinder
137 first skewing adjustment motor
200 first circumferential adjustment cylinder
291 first circumferential adjustment motor
300 second skewing adjustment cylinder
337 second skewing adjustment motor
400 second circumferential adjustment cylinder
491 second circumferential adjustment motor
542 first drive motor
548 second drive motor
556 clutch
600 control device
601 input unit

The invention claimed is:

1. An intaglio printing press comprising:

a first intaglio printing unit which includes a first impression cylinder configured to hold and convey a sheet and a first intaglio cylinder being in contact with the first impression cylinder and configured to perform intaglio printing on the sheet held by the first impression cylinder;

a second intaglio printing unit which is disposed downstream of the first intaglio printing unit in a conveying direction of the sheet and which includes a second impression cylinder configured to hold and convey the sheet from the first impression cylinder of the first intaglio printing unit and a second intaglio cylinder being in contact with the second impression cylinder and configured to perform intaglio printing on the sheet held by the second impression cylinder;

first-intaglio-printing drying means, disposed upstream of the second intaglio printing unit in the conveying direction of the sheet, for drying a printed surface of the sheet subjected to printing by the first intaglio printing unit;

a convertible unit which is disposed between the first intaglio printing unit and the second intaglio printing unit and which holds and conveys the sheet received from the first intaglio printing unit and passes the sheet to the second intaglio printing unit in such a way that a surface of the sheet to be subjected to intaglio printing by the second intaglio printing unit is switchable between one surface and another surface of the sheet; and second-intaglio-printing registration adjustment means, disposed between the convertible unit and the second intaglio printing unit, for adjusting a position of the sheet relative to a position of a pattern to be intaglio-printed by the second intaglio printing unit, wherein the second-intaglio-printing registration adjustment means includes a second-intaglio-printing skewing adjustment cylinder which is disposed between the convertible unit and the second intaglio printing unit to receive the sheet from the convertible unit and pass the sheet to the second intaglio printing unit and which has an axis inclinable with respect to an axis of the second intaglio cylinder of the second intaglio printing unit, wherein the first impression cylinder of the first intaglio printing unit and the second impression cylinder of the second intaglio printing unit are connected by only a cylinder configured to hold and convey the sheet with a gripper device.

2. An intaglio printing press comprising:

a first intaglio printing unit which includes a first impression cylinder configured to hold and convey a sheet and a first intaglio cylinder being in contact with the first impression cylinder and configured to perform intaglio printing on the sheet held by the first impression cylinder;

a second intaglio printing unit which is disposed downstream of the first intaglio printing unit in a conveying direction of the sheet and which includes a second impression cylinder configured to hold and convey the sheet from the first impression cylinder of the first intaglio printing unit and a second intaglio cylinder being in contact with the second impression cylinder and configured to perform intaglio printing on the sheet held by the second impression cylinder;

first-intaglio-printing drying means, disposed upstream of the second intaglio printing unit in the conveying direction of the sheet, for drying a printed surface of the sheet subjected to printing by the first intaglio printing unit;

a convertible unit which is disposed between the first intaglio printing unit and the second intaglio printing unit and which holds and conveys the sheet received from the first intaglio printing unit and passes the sheet to the second intaglio printing unit in such a way that a surface of the sheet to be subjected to intaglio printing by the second intaglio printing unit is switchable between one surface and another surface of the sheet; and second-intaglio-printing registration adjustment means, disposed between the convertible unit and the second intaglio printing unit, for adjusting a position of the sheet relative to a position of a pattern to be intaglio-printed by the second intaglio printing unit, wherein the second-intaglio-printing registration adjustment means includes a second-intaglio-printing circumferential adjustment cylinder which is disposed between the convertible unit and the second intaglio printing unit to receive the sheet from the convertible unit and pass the sheet to the second intaglio printing unit and a rotation phase of which relative to the second intaglio cylinder of the second intaglio printing unit is adjustable, wherein the first impression cylinder of the first intaglio printing unit and the second impression cylinder of the second intaglio printing unit are connected by only a cylinder configured to hold and convey the sheet with a gripper device.

3. The intaglio printing press according to claim 1, further comprising:

sheet feeding means for feeding the sheet to the first intaglio printing unit; and first-intaglio-printing registration adjustment means, disposed between the sheet feeding means and the first intaglio printing unit, for adjusting a position of a pattern to be intaglio-printed on the sheet by the first intaglio printing unit.

4. The intaglio printing press according to claim 3, wherein the first-intaglio-printing registration adjustment means includes a first-intaglio-printing skewing adjustment cylinder which is disposed between the sheet feeding means and the first intaglio printing unit to receive the sheet from the sheet feeding means and pass the sheet to the first intaglio printing unit and which has an axis inclinable with respect to an axis of the first intaglio cylinder of the first intaglio printing unit.

5. The intaglio printing press according to claim 3, wherein the first-intaglio-printing registration adjustment means includes a first-intaglio-printing circumferential adjustment cylinder which is disposed between the sheet feeding means and the first intaglio printing unit to receive the sheet from the sheet feeding means and pass the sheet to the first intaglio printing unit and a rotation phase of which relative to the first intaglio cylinder of the first intaglio printing unit is adjustable.

6. The intaglio printing press according to claim 1, further comprising:

first driving means for driving the first intaglio printing unit; and second driving means for driving the second intaglio printing unit.

7. The intaglio printing press according to claim 6, further comprising connecting-disconnecting means for disconnectably connecting the first driving means and the second driving means to each other.

8. The intaglio printing press according to claim 2, further comprising:

sheet feeding means for feeding the sheet to the first intaglio printing unit; and first-intaglio-printing registration adjustment means, disposed between the sheet feeding means and the first intaglio printing unit, for adjusting a position of a pattern to be intaglio-printed on the sheet by the first intaglio printing unit.

9. The intaglio printing press according to claim 8, wherein the first-intaglio-printing registration adjustment means includes a first-intaglio-printing skewing adjustment cylinder which is disposed between the sheet feeding means and the first intaglio printing unit to receive the sheet from the sheet feeding means and pass the sheet to the first intaglio printing unit and which has an axis inclinable with respect to an axis of the first intaglio cylinder of the first intaglio printing unit.

10. The intaglio printing press according to claim 8, wherein the first-intaglio-printing registration adjustment means includes a first-intaglio-printing circumferential adjustment cylinder which is disposed between the sheet feeding means and the first intaglio printing unit to receive the sheet from the sheet feeding means and pass the sheet to the first intaglio printing unit and a rotation phase of which relative to the first intaglio cylinder of the first intaglio printing unit is adjustable.

11. The intaglio printing press according to claim 2, further comprising:

first driving means for driving the first intaglio printing unit; and second driving means for driving the second intaglio printing unit.

12. The intaglio printing press according to claim 11, further comprising connecting-disconnecting means for disconnectably connecting the first driving means and the second driving means to each other.

* * * * *